United States Patent [19]

Schmoch

[11] 4,125,996

[45] Nov. 21, 1978

[54] PROTECTIVE DEVICE FOR A WASTE-GAS CHANNEL OF A GAS TURBINE IN A COMBINED GAS TURBINE-STEAM POWER PLANT

[75] Inventor: Otto Schmoch, Mulheim, Ruhr, Germany

[73] Assignee: Kraftwerk Union Aktiengesellschaft, Mulheim,Ruhr, Germany

[21] Appl. No.: 775,381

[22] Filed: Mar. 7, 1977

[30] Foreign Application Priority Data

Mar. 8, 1976 [DE] Fed. Rep. of Germany ..... 2609522

[51] Int. Cl.[2] ..... F02C 7/02

[52] U.S. Cl. ..... 60/39.09 R; 60/39.18 B; 122/7 R

[58] Field of Search ..... 60/39.18 R, 39.18 B, 60/39.09 R; 122/7 R, 7 B

[56] References Cited

U.S. PATENT DOCUMENTS

| | | | |
|---|---|---|---|
| 3,118,429 | 1/1964 | Hochmoth | 122/7R |
| 3,574,302 | 4/1971 | Csathy | 122/7 R |

OTHER PUBLICATIONS

"Energie", 27th Annual, Book 3, Mar. 1975, p. 68.

*Primary Examiner*—Louis J. Casaregola
*Attorney, Agent, or Firm*—Herbert L. Lerner

[57] ABSTRACT

In a safety device for a waste-gas channel of a gas turbine in a combined gas turbine-steam power plant, the waste-gas channel having a waste-gas bypass line as well as a waste-gas branch line to a steam generator, includes a bypass flap disposed in the bypass line and a waste-gas flap disposed in the branch line, both the flaps being openable and closable in opposition to one another, the waste-gas flap being constructed as a check flap, and motor means for driving the waste-gas flap with free-wheeling beyond a range of the end positions thereof so that, at the beginning of closing movement of the bypass flap, the waste-gas flap is drivable from the closed position thereof by the motor means until the friction of the closed position thereof is overcome, means for signaling to the bypass flap partial opening of the waste-gas flap so as only then to effect complete closing of the bypass flap, the waste-gas flap being further openable automatically in response to increasing gas pressure in the waste-gas branch line and being retainable by the motor means in open position of the waste-gas flap.

4 Claims, 5 Drawing Figures

Figure 1:
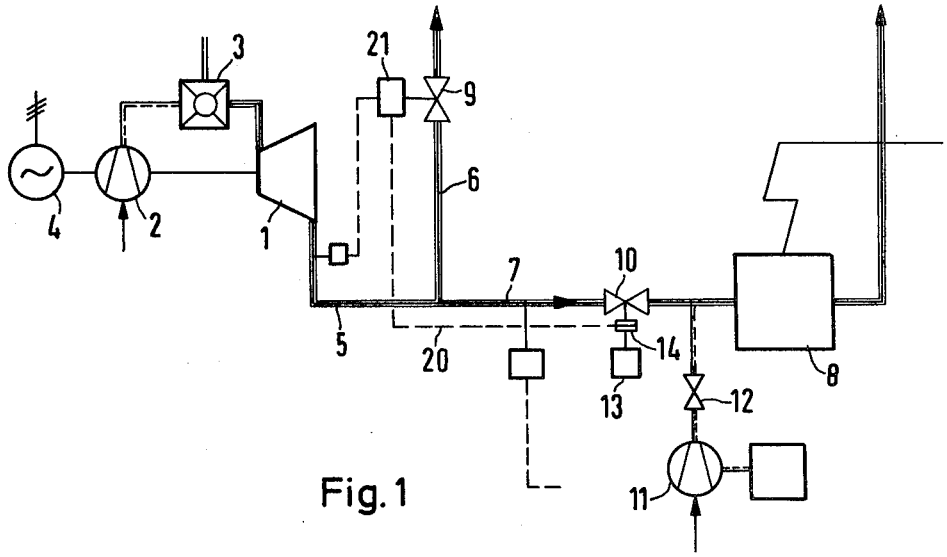

PROTECTIVE DEVICE FOR A WASTE-GAS CHANNEL OF A GAS TURBINE IN A COMBINED GAS TURBINE-STEAM POWER PLANT

The invention relates to a protective device for the waste-gas or exhaust-gas channel of a gas turbine in a combined gas turbine-steam power plant and, more particularly, for such a protective device having two parallel-connected waste-gas flap shutters, one of which is disposed in a waste-gas channel branch to the steam generator and the other of which in a waste-gas bypass, both of the flap shutters being opened or closed in opposition to one another.

A gas turbine-steam power plant of the foregoing type is described in the German publication "Energie", 27th Annual, Book 3, March 1975, pages 59 to 74, especially FIG. 14.

In such combination power plants, wherein the waste gas of the gas turbine is used a combustion air for the steam power plant, a switch-over of the boiler combustion air from fresh air to gas turbine waste gas conventionally occurs only if the waste-gas pressure behind the gas turbine has attained the full pressure of the fresh air. The flap, in the waste-gas channel branch to the steam generator, that has been closed until then is then slowly opened during throttling of the flap in the waste-gas bypass. At the occasion, the danger can arise, however, that the flap in the waste-gas channel branch to the steam generator, hereinafter referred to as the waste-gas flap, will become jammed or stuck after it leaves the closed position thereof, while the flap in the waste-gas bypass, hereinafter referred to as the bypass flap, will continue to turn and will close. Then, at a given setting of the bypass flap, the presure behind the gas turbine will increase to such a great extent that considerable disturbances in the waste-gas system and danger to the outer surroundings can occur.

In order to prevent the jamming or sticking of the waste-gas flap, it could be constructed as a check or reversal flap, in the order of a check valve. This has the disadvantage, however, that for conventional pipe diameters of more than two meters (2m) and high waste-gas temperatures, an adequate tightness or sealing during fresh-air fan-operation of the steam power plant is unattainable, that also for a full quantity of waste gas, the check flap does not fully open because of the restoring force thereof, so that a very great pressure drop and power loss, accordingly, is thereby produced, and that, furthermore, during disturbances of the steam power plant, the gas turbine can be driven only if an additional flap with a suitable drive therefor were installed.

It is accordingly an object of the invention to provide a protective device for such a waste-gas channel of a gas turbine with which a reliable swithch-over of the combustion air supply for the steam power plant from fresh air to waste gas of the gas turbine is assured without any danger of faulty operation of any of the flaps.

With the foregoing and other objects in view, there is provided, in accordance with the invention, a safety device for a waste-gas channel of a gas turbine in a combined gas turbine-steam power plant, the waste-gas channel having a waste-gas bypass line as well as a waste-gas branch line to a steam generator, comprising a bypass flap disposed in the bypass line and a waste-gas flap disposed in the branch line, both the flaps being openable and closable in opposition to one another, the waste-gas flap being constructed as a check flap, and motor means for driving the waste-gas flap with free-wheeling beyond a range of the end position thereof so that, at the beginning of closing movement of the bypass flap, the waste-gas flap is drivable from the closed position thereof by the motor means until the friction of the closed position thereof is overcome, means for signaling to the bypass flap partial opening of the waste-gas flap so as only then to effect complete closing of the bypass flap, the waste-gas flap being further openable automatically in response to increasing gas pressure in the waste-gas branch line and being retainable by the motor means in open position of the waste-gas flap.

Through this construction of the waste-gas flap as a check flap and as a motor-driven flap as well as the corresponding dependence of the respective flap movements in the waste-gas channel branch, jamming or sticking of the waste-gas flap and endangerment of the waste-gas system can thereby be reliably avoided.

For the selective functioning of the waste-gas flap as a check flap or as a motor-driven flap, there is provided, the accordance with another feature of the invention, a claw coupling disposed between the waste-gas flap and the motor means therefor, the claw coupling comprising a first coupling flange secured to the waste-gas flap and a second coupling flange secured to the motor means, each of the coupling flanges having a respective pair of entrainers, the pairs of entrainers being operatively engageable one with the other.

In accordance with a further feature of the invention, each of the entrainers is circular segment-shaped, and each pair of the circular segment-shaped entrainers respectively of the first and second coupling flanges extends over a circumferential angle of at most 90°.

In accordance with an additional feature of the invention, the bypass flap and the waste-gas flap are disposed in parallel with one another in the respective bypass line and waste-gas branch line.

Other features which are considered as characteristic for the invention are set forth in the appended claims.

Although the invention is illustrated and described herein as embodied in protective device for a waste-gas channel of a gas turbine in a combined gas turbine-steam power plant, it is nevertheless not intended to be limited to the details shown, since various modifications and structural changes may be made therein without departing from the spirit of the invention and within the scope and range of equivalents of the claims.

Figure 2:
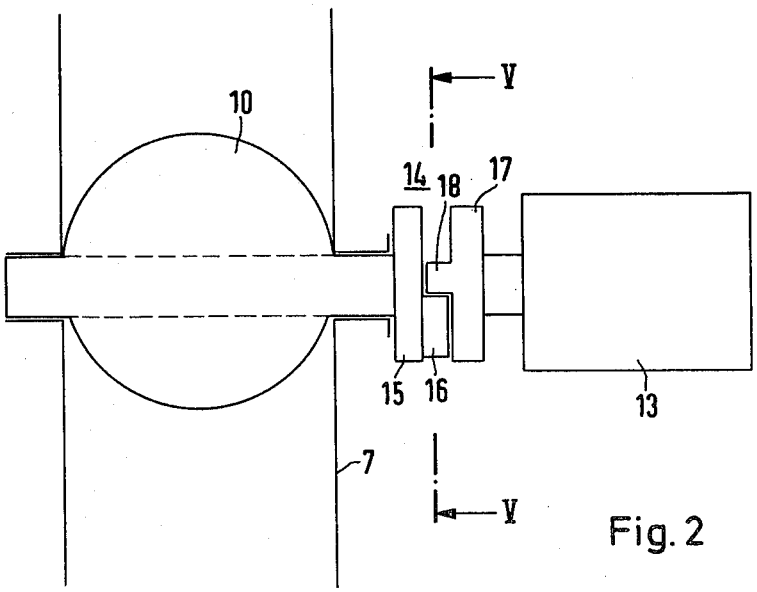
Figure 3:
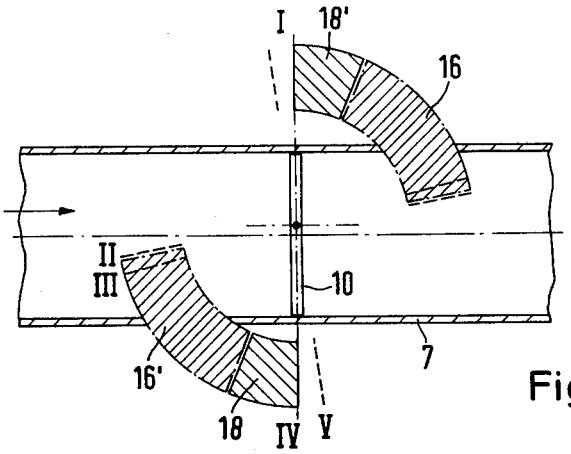
Figure 4:
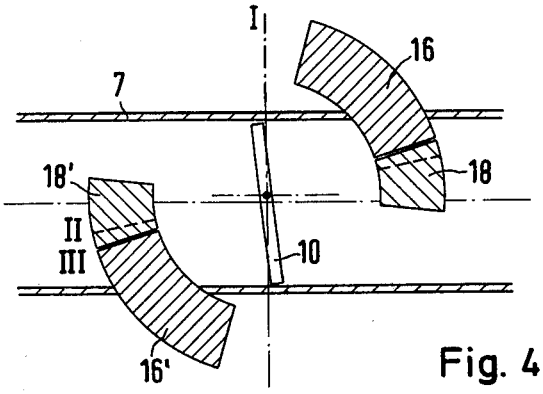
Figure 5:
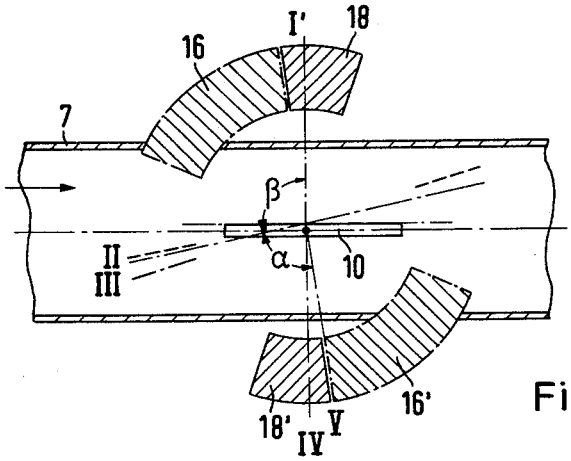

The construction and method of operation of the invention, however, together with additional objects and advantages thereof will be best understood from the following description of specific embodiments when read in connection with the accompanying drawings, in which:

FIG. 1 is a schematic diagram of the connections of a combined gas turbine-steam power plant wherein a protective device for the waste-gas channel of the gas turbine in accordance with the invention is incorporated;

FIG. 2 is an enlarged fragmentary view of FIG. 1 showing the protective device in diagrammatic plan view including a flap shutter installed in a branch of the waste-gas channel leading to the steam generator as well as a coupling from the flap shutter to a drive motor; and FIG. 3 to 5 are cross-sectional views of FIG. 2 in these different phases of operation of the protective device taken along the line V—V in direction of the arrows, FIG. 3 being a view of the flap and entrainer portions of the coupling in closed position of the flap shutter, FIG. 4 being a view corresponding to that of FIG. 3 with the flap shutter and coupling entrainers in a position just after the closed-position friction has been overcome, and FIG. 5 being a view corresponding to those of FIGS. 3 and 4 with the flap shutter in fully open position.

Referring now to the drawing and first, particularly, to FIG. 1 thereof, there is shown schematically a combined gas turbine-steam power plant including a gas turbine 1 with a compressor 2, a combustion chamber 3 and an electric generator 4 seated on the gas turbine 1. Waste gas from the gas turbine 1 passes through a waste-gas channel 5 and can either be conducted through a waste-gas bypass 6 or through a waste-gas channel branch 7 as combustion air to a steam generator 8. A bypass flap shutter 9 is disposed in the waste-gas channel branch 6, and a waste-gas flap shutter 10 in the waste-gas channel 7 to the steam generator 8, the flap shutters 9 and 10 opening and closing opposite to one another as is described hereinafter in greater detail.

The manner in which the power plant functions is explained hereinafter with respect to the start-up operation for the gas turbine 1. It is assumed that the steam generator 8 is already in operation. If the gas turbine 1 is then started up, the waste-gas flap 10 is initially closed and the bypass flap 9 is opened. Combustion air for the steam generator 8 is fed through a fresh-air fan and a fresh-air flap shutter 12 to the steam generator 8. Air at a superpressure of substantially 15 to 100 mbar thus prevails in the pipeline branch between the waste-gas flap 10 and the steam generator 8. If the gas turbine 1 has then reached full operational speed and the electric generator 4 is synchronized with the electric supply mains, the bypass flap 9 is throttled down until the pressure behind the gas turbine 1 equals the air pressure between the flap 10 and the steam generator 8. The waste-gas flap 10 must then open while the bypass flap 9 is further closed. In the fully operational condition, the bypass flap is closed, the waste-gas flap 10 is open, the fan 11 is inoperative and the fres-air flap 12 is also closed.

In order to ensure trouble-free functioning of the waste-gas Flap 10, in accordance with the invention, the waste-gas flap 10 is constructed as a motor-driven check or reversal flap with free-wheeling or coasting beyond the limits of the end positions thereof. For this purpose, a claw or dog coupling 14 is connected between the drive motor 13 and the waste-gas flap 10, as can be seen especially in the diagrammatic plan view of FIG. 2. A coupling flange 15, that is connected to the flap 10, has two circular segment-shaped entrainers 16 and 16' (note also FIGS. 3 to 5), while on a coupling flange, that is connected to the drive motor 13, two circular segment-shaped entrainers 18 and 18' are also disposed. Each pair of mutually associated entrainers 16, 18, on the one hand, and 16', 18', on the other hand, of the respective coupling flanges of the flap 10 and the motor 13 extend over a circumferential angle of at most 90° , so that a predetermined free-wheeling of the waste-gas flap 10 and accordingly a functioning thereof as a check or reversal flap is possible.

The manner in which the protective device according to the invention and the claw or dog coupling function is explained hereinafter with respect to the diagrammatic views of FIGS. 3 to 5 showing various phase positions thereof. For better viewing clarity, FIGS. 3 to 5 show the respective positions of the coupling entrainers 16,18, 16', 18' and the corresponding location of the waste-gas flap 10 in the pipeline 7, with the waste-gas flap 10 greatly reduced in size and also shown in cross section although it is beyond the cross-sectional plane of the coupling entrainers 16, 18, 16', 18'.

The start-up of the gas turbine 1 described hereinbefore with respect to FIG. 1 while the steam generator 8 is already in operation, wherein the bypass flap 9 is closed and the waste-gas flap 10 is opened, occurs in the following manner: As can be seen from FIG. 3, the entrainers 18 and 18' of the motor coupling flange, through the entrainers 16 and 16' of the flap coupling flange, keep the flap 10 initially closed. The motor entrainers 18' and 18 then run without load from the starting position I into the position II until they engage the entrainers 16' and 16, respectively, of the flap 10 which, due to the over-pressure of the fresh-air fan 11, remains in the original position thereof because it is constructed as a check or reversal flap. During further travel from the position II to the position III, the waste-gas flap 10 is initially lifted slightly from the seat thereof until it has overcome the friction at the closed position I thereof, so that a setting of the waste-gas flap 10 and the entrainers 16, 18 16', 18' as shown in FIG. 4 is produced. Only after the position III of the entrainers 16' and 16 and of the flap 10 has been reached, is a signal transmitted through a non-illustrated terminal switch and a signal line 20 (FIG. 1) to the drive 21 of the bypass flap 9, and the latter begins to close. The pressure in the waste-gas line 7 forward of the waste-gas flap 10 thereupon increases. If the pressure in the waste-gas line 7 forward of the waste-gas flap 10 exceeds the fresh-air pressure behind the waste-gas flap 10, the latter flap 10 thus begins to open automatically as a check or reversal flap. The fresh air supplied is thus throttled. The waste-gas flap 10 is located then approximately in the position IV, as shown in FIG. 5. In order then to prevent swinging and throttling of the waste-gas flow, the entrainers 18 and 18' of the drive motor 13 then travel from the position III toward the position V and entrain the entrainers 16 and 16' of the waste-gas flap 10. The waste-gas flap 10 then turns until it reaches a stop and is accordingly fully opened. The drive motor 13 can then, as usual, be switched off in dependence upon the torque.

After the conclusion of the reversal or switch-over operation, the waste-gas flap 10 is clearly and unequivocally fixed in the open position thereof; during the reversal or switch-over operation per se, the waste-gas flap 10 operates as a check flap so that all danger for the waste-gas line 7 is avoided.

If the gas turbine 1 should be removed from the operation of the combination, the operation takes place in reverse in the following steps: The fresh-air fan 11 according to FIG. 1 is switched on with the smallest delivery setting. The entrainers 18 and 18' on the side of the motor 13 travel from the position V to the position II. The flap 10 can then function as a check flap, this setting is signaled and induces or causes the bypass flap 9 to open. Due to the reduction of pressure behind the gas turbine 1, the waste-gas flap 10 gradually closes, the fresh-air fan 11 accordingly replacing the deficient amount of waste gas. If the bypass flap 9 is fully opened, the waste-gas flap 10 has been closed. The waste-gas flap 10 is disposed near the position I thereof. The entrainers 18 and 18' travel toward the position I thereof and bring the waste-gas flap 10 into the closed position thereof. The last-mentioned position is signaled and the drive motor 13 switched off so that the gas turbine 1 can then be started up.

Also in this case, there does not arise, at any instant, any danger for the waste-gas line 7 or for the undisturbed operation of the steam power plant.

It may be advantageous to traverse the stretches that are without load from position I to position II and from position V to position II with rapid power traverse. The setting time of the flap 10 is no longer of any significance in this case. To lift the flap 10 from the seat thereof between the position II and the position III can be suitably increased by reducing the setting speed of the torque. The same applies to the application of pressure ot the flap 10 behind the position IV. The aforedescribed device operates trouble-free only if the rotary angle $\beta$ of the entrainers 18 and 18' at the side of the motor 13 is larger than the rotary angle $\alpha$ of the flap 10.

There is claimed:

1. Safety device for a waste-gas channel of a gas turbine in a combined gas turbine-steam power plant, the waste-gas channel having a waste-gas bypass line as well as a waste-gas branch line to a steam generator, comprising a bypass flap disposed in the bypass line and a waste-gas flap disposed in the branch line, both said flaps being openable and closable in opposition to one another, said waste-gas flap having means for checking the flow of waste-gas, means for free-wheeling mounting said waste-gas flap, and motor means for driving said waste-gas flap beyond a range of the end positions thereof so that, at the beginning of closing movement of said by pass flap, said waste-gas flap is drivable from the closed position thereof by said motor means until the friction of said closed position thereof is overcome, means for signaling to said bypass flap partial opening of said waste-gas flap so as only then to effect complete closing of said bypass flap, means for automatically further opening said waste-gas flap in response to increasing gas pressure in said waste-gas branch line and being retainable by said motor means in open position of the waste-gas flap.

2. Protective device according to claim 1 wherein said checking means and said free-wheeling mounting means includes a claw coupling disposed between said waste-gas flap and said motor means therefor, said claw coupling comprising a first coupling flange secured to said waste-gas flap and a second coupling flange secured to said motor means, each of said coupling flanges having a respective pair of entrainers, said pairs of entrainers being operatively engageable one with the other.

3. Protective device according to claim 2, wherein each of said entrainers is circular segment-shaped, and each pair of the circular segment-shaped entrainers respectively of said first and second coupling flanges extends over a circumferential angle of at most 90°.

4. Protective device according to claim 1, wherein said bypass flap and said waste-gas flap are disposed in parallel with one another in the respective bypass line and waste-gas branch line.

* * * * *